US009129732B2

(12) United States Patent
Rwei

(10) Patent No.: US 9,129,732 B2
(45) Date of Patent: Sep. 8, 2015

(54) MAGNETORHEOLOGICAL FLUID COMPOSITION AND METHOD FOR FORMING THE SAME

(71) Applicant: National Taipei University of Technology, Taipei (TW)

(72) Inventor: Syang-Peng Rwei, Taipei (TW)

(73) Assignee: National Taipei University of Technology, Taipei (TW)

( * ) Notice: Subject to any disclaimer, the term of this patent is extended or adjusted under 35 U.S.C. 154(b) by 155 days.

(21) Appl. No.: 13/937,813

(22) Filed: Jul. 9, 2013

(65) Prior Publication Data

US 2015/0014572 A1 Jan. 15, 2015

(51) Int. Cl.
*H01F 1/44* (2006.01)

(52) U.S. Cl.
CPC ..... *H01F 1/445* (2013.01)

(58) Field of Classification Search
CPC ..... H01F 1/44; H01F 1/442; H01F 1/445; H01F 1/447; F16F 9/53; F16F 9/532; F16F 9/535; B82Y 30/00; B82Y 40/00; B82Y 99/00; C10M 171/001; C10N 2220/082
USPC ..... 252/62.54, 62.52, 62.53; 977/902, 742
See application file for complete search history.

(56) References Cited

U.S. PATENT DOCUMENTS

2003/0119943 A1* 6/2003 Tucker et al. ..... 523/160
2005/0003289 A1* 1/2005 Fushimi et al. ..... 430/108.3
2012/0236064 A1* 9/2012 Iftime et al. ..... 347/20

FOREIGN PATENT DOCUMENTS

CN 1658341 A * 8/2005

OTHER PUBLICATIONS http://www.shell.com/content/dam/shell-new/local/corporate/trading-shipping/downloads/msds/in-country/singapore-sietco/bo-yubase-6---sietco---en.pdf (Yubase, MSDS), effective Jan. 20, 2014, pp. 1-11.* http://www.hielscher.com/inkjet_ink_01.htm (Ultrasonic Size Reduction of Ink), printed Feb. 5, 2015, copyright 1999-2015, pp. 1-3.*

Fang et al., "Fabrication of multiwalled carbon nanotube-wrapped magnetic carbonyl iron microspheres and their magnetorheology", published online Oct. 27, 2009, Colloid Polym Sci, vol. 288, pp. 79-84.*

Ko et al.,"Magnetorheological carbonyl iron particles doubly wrapped with polymer and carbon nanotube", published online Feb. 5, 2009, Journal of Applied Physics, vol. 105, pp. 07E703-1 to 07E703-3.*

(Continued)

*Primary Examiner* — Matthew E Hoban
*Assistant Examiner* — Lynne Edmondson
(74) *Attorney, Agent, or Firm* — Muncy, Geissler, Olds & Lowe, P.C.

(57) ABSTRACT

The present invention provides a magnetorheological fluid composition and method for forming the same. The magnetorheological fluid composition comprises a carrier fluid and a nano-magnetic-responsive composite dispersed uniformly in the carrier fluid. The nano-magnetic-responsive composite is formed by having carbonyl iron microparticles react with a grafting agent to form a modified carbonyl iron nanoparticles and blending the modified carbonyl iron nanoparticles with acid-treated graphene or carbon nanotubes.

12 Claims, 1 Drawing Sheet

(56) References Cited

OTHER PUBLICATIONS

Fang et al.,and "Carbon nanotube coated magnetic carbonyl iron microspheres prepared by solvent casting method and their magneto-responsive characteristics", available online Jul. 21, 2012, Colloids and Surfaces A: Physicochem. Eng. Aspects, 412, pp. 47-56.*
Google patent translation of CN1658341A, printed Feb. 4, 2015.*

* cited by examiner

MAGNETORHEOLOGICAL FLUID COMPOSITION AND METHOD FOR FORMING THE SAME

BACKGROUND OF THE INVENTION a. Field of the Invention

The invention relates to a magnetorheological fluid composition and method for forming the same.

b. Description of the Related Art

Generally, a shock absorber or damper at least comprises a shock absorbing mechanism, for example, formed by a spring and an oil cylinder where the spring is used to absorb the instant vibrating energy and then releasing the energy after absorption is consumed by viscous friction of the fluid (oil) in the oil cylinder. The spring in the damper determines the capability of shock absorption but in practice the vibrating energy varies while the fluid (oil) has only a certain range of energy loading. That is, if viscous friction of the fluid is too small, it is over loaded for large energy release to have the residual energy keep vibrating. On the contrary, if viscous friction of the fluid is too large, it is not sensitive for small energy release to cause failure in shock absorption. Therefore, in order to improve the traditional damper, it is expected to have viscous friction of a fluid be varied with the magnitude of vibration. For example, a fluid having viscous friction varying with the strength of a magnetic field can be used as a smart damper.

A magnetorheological fluid generally comprises at least magnetic responsive particles and a carrier fluid where the average diameter of the magnetic responsive particles is about 0.1~500 μm. Under no magnetic field, the magnetorheological fluid acts as a Newtonian fluid while under a magnetic field it acts as a Bingham fluid that has yield stress variation more than KPa. The viscosity of the magnetorheological fluid varies with the strength of the magnetic field applied thereon and then the state of the fluid may become solid-like which is extensively used as material for damping control, such as smart dampers or shock absorbers for various devices, especially for automobile.

However, the magnetic responsive particles in the magnetorheological fluid have larger particle size and thus Brownian motion cannot stop particle precipitation and aggregation. Therefore, various countermeasures are developed to prevent particle precipitation and aggregation. For example, a method of using surfactant(s) is used. But, such a method cannot change the density of particles and thus cannot resist particle precipitation in the carrier fluid because these magnetic responsive particles usually have much larger density than that of the carrier fluid. On the other hand, according to the prior art disclosed by U.S. Pat. No. 6,203,717, a stable magnetorheological fluid comprising organoclay is disclosed to reduce the precipitation rate of particles. However, in order to evenly blend organoclay, magnetic material such as carbonyl iron powders, and organic oil such as silicone oil, additional agents should be added. Not only production complexity but also production cost is increased. The stability of the additional agents should be considered.

BRIEF SUMMARY OF THE INVENTION

In light of the above background, in order to fulfill the requirements of the industry, one object of the invention provides a magnetorheological fluid composition and a method for forming the same having a high yield stress and good dispersion by utilizing a nano-magnetic-responsive composite.

Another object of the invention provides a damping-controllable magnetorheological fluid material having an adjustable viscous friction coefficient by controlling the strength of a magnetic field applied thereon.

Other objects and advantages of the invention can be better understood from the technical characteristics disclosed by the invention. In order to achieve one of the above purposes, all the purposes, or other purposes, one embodiment of the invention provides a magnetorheological fluid composition. The magnetorheological fluid composition comprises a carrier fluid and a nano-magnetic-responsive composite dispersed uniformly in the carrier fluid. The nano-magnetic-responsive composite is formed by having carbonyl iron microparticles react with a grafting agent to form a modified carbonyl iron nanoparticles and blending the modified carbonyl iron nanoparticles with acid-treated graphene or carbon nanotubes.

The nano-magnetic-responsive composite in the carrier fluid has a precipitation rate less than 0.1 wt % after blending within one hour.

In one embodiment, the grafting agent comprises a carboxyl moiety and an amino moiety and the grafting agent is bonded to the modified carbonyl iron nanoparticle through the carboxyl moiety. The grafting agent is preferably 4-aminobenzoic acid.

In one embodiment, the modified carbonyl iron nanoparticles are bonded to the acid-treated graphene or carbon nanotubes through self-assembly to form the nano-magnetic-responsive composite.

In one embodiment, having carbonyl iron microparticles react with a grafting agent is performed by blending the modified carbonyl iron microparticles with the grafting agent to form a mixture solution and applying supersonic oscillation to the mixture solution until the mixture solution becomes uniform.

In one embodiment, the nano-magnetic-responsive composite has a nano-scaled dimension of 10~100 nm and has a lengthwise dimension, other than the nano-scaled dimension, of 0.5~5 μm; the acid-treated graphene or carbon nanotubes has a nano-scaled dimension of 5~50 nm and has a lengthwise dimension, other than the nano-scaled dimension, of 0.5~20 μm; and the modified carbonyl iron nanoparticle has an average diameter of 5~20 nm.

In one embodiment, the carrier fluid is a fluid of organic compounds. In another embodiment, the carrier fluid is selected from the group consisting of the following: silicone oil, mineral oil and paraffin oil.

In one embodiment, the magnetorheological fluid composition has a yield stress more than 2000 Pa at magnetic strength of 12030 Gs (Gauss).

In one embodiment, the nano-magnetic-responsive composite is 10~15 wt % of the magnetorheological fluid composition and a weight ratio of the modified carbonyl iron nanoparticles added in the magnetorheological fluid composition to the acid-treated graphene or carbon nanotubes is 0.01%~0.5%.

According to one embodiment of the invention, a method for forming a magnetorheological fluid composition is provided. The method for forming a magnetorheological fluid composition comprises the following steps: providing carbonyl iron microparticles; simultaneously breaking down the carbonyl iron microparticles and having them react with a grafting agent so as to form modified carbonyl iron nanoparticles; blending the modified carbonyl iron nanoparticles with acid-treated graphene or carbon nanotubes and stirring until uniform to form a nano-magnetic-responsive composite through self-assembly; and adding the nano-magnetic-responsive composite into a carrier fluid and stirring until uniform to form a magnetorheological fluid composition.

According to another embodiment of the invention, a damping-controllable magnetorheological fluid material is provided. The damping-controllable magnetorheological fluid material comprises: 85~90 wt % of carrier fluid; and 10~15 wt % of nano-magnetic-responsive composite, stably dispersed in the carrier fluid wherein the nano-magnetic-responsive composite is formed by having carbonyl iron microparticles react with a grafting agent to form modified carbonyl iron nanoparticles and blending the modified carbonyl iron nanoparticles with acid-treated graphene or carbon nanotubes; wherein the grafting agent comprises a carboxyl moiety and an amino moiety; the grafting agent is bonded to the modified carbonyl iron nanoparticle through the carboxyl moiety; and the damping control magnetorheological fluid material has a yield stress more than 2000 Pa at magnetic strength of 12030 Gs.

According to the magnetorheological fluid composition and the method for forming the same of the present invention, a nano-magnetic-responsive composite is used so as to make the magnetorheological fluid composition have a high yield stress and good dispersion and have variable viscous friction with the change of the magnetic field applied thereon. Thus, the magnetorheological fluid composition can be applied in a smart damper for various devices because of its damping-controllable property. Furthermore, because of its variation in viscosity, the magnetorheological fluid composition can be applied in substance separation, loading or sealing for mechanical devices.

Other objectives, features and advantages of the invention will be further understood from the further technological features disclosed by the embodiments of the invention wherein there are shown and described preferred embodiments of this invention, simply by way of illustration of modes best suited to carry out the invention.

DETAILED DESCRIPTION OF THE INVENTION

In the following detailed description of the preferred embodiments, reference is made to the accompanying drawings which form a part hereof, and in which are shown by way of illustration specific embodiments in which the invention may be practiced. The drawings are only schematic and the sizes of components may be exaggerated for clarity. It is to be understood that other embodiments may be utilized and structural changes may be made without departing from the scope of the invention. Also, it is to be understood that the phraseology and terminology used herein are for the purpose of description and should not be regarded as limiting. The common structures and elements that are known to everyone are not described in details to avoid unnecessary limits of the invention. Some preferred embodiments of the present invention will now be described in greater detail in the following.

According to a first embodiment of the invention, a magnetorheological fluid composition is provided. The magnetorheological fluid composition comprises a carrier fluid and a nano-magnetic-responsive composite dispersed uniformly in the carrier fluid. The nano-magnetic-responsive composite is formed by having carbonyl iron microparticles react with a grafting agent to form a modified carbonyl iron nanoparticles and blending the modified carbonyl iron nanoparticles with acid-treated graphene or carbon nanotubes.

Figure 1:
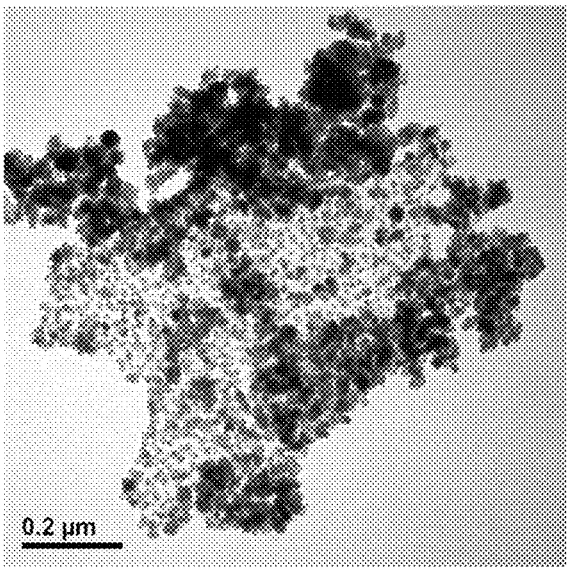
FIG. 1 shows a cross-sectional schematic diagram illustrating a TEM image of the structure of a magnetorheological fluid composition according to one embodiment of the invention.

In the present invention, the so-called nano-magnetic-responsive composite is a nano-composite having a magnetic-responsive property. The nano-composite is formed by bonding nano-particles to a molecule (such as nanowires) having a length much larger than its width (or wire diameter). In the present invention, the magnetic-responsive property means that a substance has low viscosity under no magnetic field, being in a fluid-like state, but has a variable viscosity under influence of a magnetic field, that is, the magnetorheological characteristic. Specifically, the variation amount of the yield stress between with and without influence of a magnetic field can be more than 1K Pa. Furthermore, the present invention uses graphene or carbon nanotubes as the major structure, that is, the magnetic nanoparticles are bonded to the structure of the graphene or carbon nanotubes. Under electronic microscope, magnetic nanoparticles are bonded on the major structure of the flake-shaped graphene or chain-shaped carbon nanotubes. The structure of the nano-composite is used in the present invention to reduce the effective density of particles so as to be able to be dispersed easily in a carrier fluid to thereby reduce the precipitation rate. For example, FIG. 1 shows a cross-sectional schematic diagram illustrating a TEM image of the structure of a magnetorheological fluid composition according to one embodiment of the invention where the nano-magnetic-responsive composite is formed by bonding magnetic nanoparticles to the major structure of the flake-shaped graphene. In addition, FIG. 1 shows a cross-sectional schematic diagram illustrating a TEM image of the structure of a magnetorheological fluid composition according to another embodiment of the invention where the nano-magnetic-responsive composite is formed by bonding magnetic nanoparticles to the major structure of the chain-shaped carbon nanotubes. Therefore, the magnetorheological fluid composition provided by this invention can solve the above problems of particle precipitation and aggregation. In the present invention, the so-called yield stress is the force needed for a Bingham fluid to flow under influence of a magnetic field.

In the present invention, modified iron powders are used as the source of the magnetic nanoparticles. The modified iron powders are mixed with a grafting agent to have reaction at the same time the mixture is placed in a supersonic oscillator to break the microparticles into nanoparticles so as to form modified iron nanoparticles.

The two ends of the above mentioned grafting agent comprise a carboxyl moiety and an amino moiety, respectively. One end of the grafting agent having the carboxyl moiety is bonded to the carbonyl iron microparticles and the other end of the grafting agent having the amino moiety (as a positively-charged moiety) can be used to bond with the carboxyl moiety (—COOH, as a negatively-charged moiety) of the modified (acid-treated) graphene or carbon nanotubes. By the above method, the modified iron nanoparticles are bonded to the modified (acid-treated) graphene or carbon nanotubes through self-assembly so as to form a nano-magnetic-responsive composite. Preferably, the mentioned grafting agent is 4-aminobenzoic acid.

Figure 2:
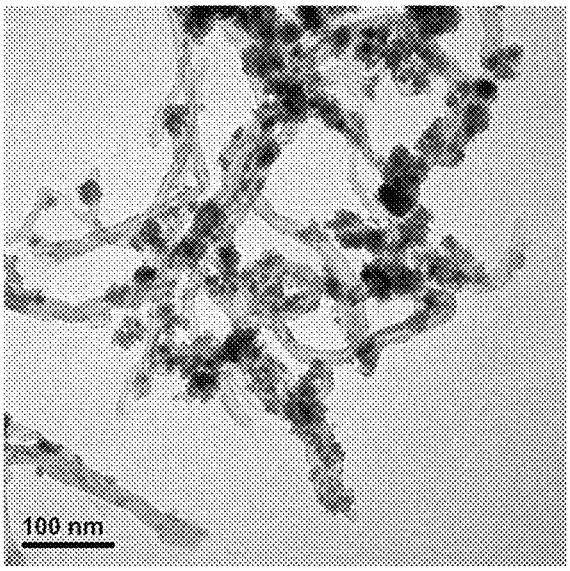
FIG. 2 shows a cross-sectional schematic diagram illustrating a TEM image of the structure of a magnetorheological fluid composition according to another embodiment of the invention.

The above nano-magnetic-responsive composite has a nano-scaled dimension of 10~100 nm and has a lengthwise dimension, other than the nano-scaled dimension, of 0.5~5

μm; the acid-treated graphene or carbon nanotubes has a nano-scaled dimension of 5~50 nm and has a lengthwise dimension, other than the nano-scaled dimension, of 0.5~20 μm; and the modified carbonyl iron nanoparticle has an average diameter of 5~20 nm. The nano-scaled dimension of the above nano-magnetic-responsive composite, acid-treated graphene or carbon nanotubes, and carbon nanotubes is referred to one dimension in the structure being nano-scaled while the other dimension, usually called "length" in the present specification usually is larger, such as having micron scaled. As shown in FIG. 1 and FIG. 2, modified iron nanoparticles are bonded on the larger structure of the graphene or carbon nanotubes to form a composite. In the following, the dimensions of nano-magnetic-responsive composite, acid-treated graphene or carbon nanotubes, and carbon nanotubes have the same meaning described here. Furthermore, when modified iron nanoparticles are bonded on the larger structure of the graphene or carbon nanotubes, that is, during blending, supersonic oscillation is used and thus the length of the obtained nano-magnetic-responsive composite is less than that of the acid-treated graphene or carbon nanotubes.

The carrier fluid is non-magnetic and mostly is of organic compounds. For example, the carrier fluid can be silicone oil, mineral oil or paraffin oil.

The nano-magnetic-responsive composite in the carrier fluid has a precipitation rate less than 0.1 wt % after blending within one hour. That is, after blending to form an evenly-dispersed magnetorheological fluid composition, the particle precipitation rate is tested for hours. When the first hour after blending (that is, the testing time is 60 minutes or one hour) reaches, the particle precipitation rate of the magnetorheological fluid composition according to the invention is less than 0.1 wt % of the nano-magnetic-responsive composite in the magnetorheological fluid composition. The reason of using one-hour testing time is because the magnetorheological fluid composition is considered stable when the first hour after blending (that is, the testing time is 60 minutes or one hour) reaches. The yield stress of the magnetorheological fluid composition is more than 1000 Pa, preferably more than 2000 Pa. Under the higher magnetic field, the yield stress of the magnetorheological fluid composition becomes larger. Besides, the more the nano-magnetic-responsive composite is added, that is, the higher the concentration of the nano-magnetic-responsive composite is, the yield stress of the magnetorheological fluid composition becomes larger. For example, the yield stress of the magnetorheological fluid composition can be more than 8000 Pa. However, in consideration of usability, dispersion and cost, in the present invention, preferably, the nano-magnetic-responsive composite is 10~15 wt % of the magnetorheological fluid composition and a weight ratio of the modified carbonyl iron nanoparticles added in the magnetorheological fluid composition to the acid-treated graphene or carbon nanotubes is 0.01%~0.5%.

Furthermore, according to a second embodiment of the invention, a method for forming a magnetorheological fluid composition is provided. The method for forming a magnetorheological fluid composition comprises the following steps: providing carbonyl iron microparticles; simultaneously breaking down the carbonyl iron microparticles and having them react with a grafting agent so as to form modified carbonyl iron nanoparticles; blending the modified carbonyl iron nanoparticles with acid-treated graphene or carbon nanotubes and stirring until uniform to form a nano-magnetic-responsive composite through self-assembly; and adding the nano-magnetic-responsive composite into a carrier fluid and stirring until uniform to form a magnetorheological fluid composition.

The above stirring process is performed by using a magnetic stirrer and a supersonic oscillator. Preferably, the above mentioned grafting agent is 4-aminobenzoic acid. The carrier fluid is non-magnetic and mostly is of organic compounds. For example, the carrier fluid can be silicone oil, mineral oil or paraffin oil. In consideration of usability, dispersion and cost, in the present invention, preferably, the nano-magnetic-responsive composite is 10~15 wt % of the magnetorheological fluid composition and a weight ratio of the modified carbonyl iron nanoparticles added in the magnetorheological fluid composition to the acid-treated graphene or carbon nanotubes is 0.01%~0.5%.

Furthermore, according to a third embodiment of the invention, a damping-controllable magnetorheological fluid material is provided. The damping-controllable magnetorheological fluid material comprises: 85~90 wt % of carrier fluid; and 15~10 wt % of nano-magnetic-responsive composite, stably dispersed in the carrier fluid wherein the nano-magnetic-responsive composite is formed by having carbonyl iron microparticles react with a grafting agent to form modified carbonyl iron nanoparticles and blending the modified carbonyl iron nanoparticles with acid-treated graphene or carbon nanotubes; wherein the grafting agent comprises a carboxyl moiety and an amino moiety; the grafting agent is bonded to the modified carbonyl iron nanoparticle through the carboxyl moiety; and the damping control magnetorheological fluid material has a yield stress more than 2000 Pa.

Preferably, the mentioned grafting agent is 4-aminobenzoic acid. The modified carbonyl iron nanoparticles are bonded to the acid-treated graphene or carbon nanotubes through self-assembly to form the nano-magnetic-responsive composite. The nano-magnetic-responsive composite has a nano-scaled dimension of 10~100 nm and has a lengthwise dimension, other than the nano-scaled dimension, of 0.5~5 μm. The acid-treated graphene or carbon nanotubes has a nano-scaled dimension of 5~50 nm and has a lengthwise dimension, other than the nano-scaled dimension, of 0.5~20 μm. The modified carbonyl iron nanoparticle has an average diameter of 5~20 nm.

The following uses examples to further illustrate the present invention in details.

Example 1

Preparation of Magnetorheological Fluid Composition I (1) Acid-Treated Carbon Nanotubes A conventional acid washing method was used. Carbon nanotubes (a ratio of the length (L) to diameter (D) (L/D) was about 500~1000, purchased from T-Tek Co., LTD.) were dipped into nitric acid or sulfuric acid solution and then processed by supersonic oscillation to obtain the acid-treated carbon nanotubes grafted with carboxyl moieties (—COOH).

(2) Preparation of Modified Carbonyl Iron Nanoparticles

4-Aminobenzoic acid 2 g (purchased from SIGMA) was mixed with deionized water 33.5 ml and stirred for 1~3 hrs by a magnetic stirrer. Carbonyl iron powder (purchased from BASF) 5.3 g was added to form a mixture solution. The mixture solution was under supersonic oscillation for 12~20 mins and deionized water was used to wash away 4-Aminobenzoic acid. Strong magnet was used to attract all black solids and the upper layer solution was discarded. The above washing process was repeated until the upper layer solution becomes colorless. Then, deionized water was used to dilute the solution to have a total volume of 75 ml. Thus, the solution containing modified carbonyl iron nanoparticles was obtained.

(3) Preparation of Carbon-Nanotube/Carbonyl Iron-Nano-Magnetic-Responsive Composite The acid-treated carbon nanotubes (CNT-COOH) 5.3 mg was added into the solution containing modified carbonyl iron nanoparticles and the mixture stayed supersonic oscillation for 24 hrs. After supersonic oscillation, large amount of deionized water was used to wash. Strong magnet was used to attract all black solids and the upper layer solution was discarded. The above washing process was repeated until the upper layer solution becomes colorless. Finally, a freeze-dryer was used to remove deionized water to obtain the graphene/carbonyl iron-nano-magnetic-responsive composite.

(4) Preparation of Magnetorheological Fluid Composition I

In silicone oil (purchased from Dow, polydimethylsiloxane), the carbon-nanotube/carbonyl iron-nano-magnetic-responsive composite was added to have solid content of 12 wt % so as to obtain the magnetorheological fluid composition I.

Example 2

Preparation of Magnetorheological Fluid Composition II

Except for having solid content of 43 wt %, example 2 used the same procedure as example 1 so as to obtain the magnetorheological fluid composition II.

Example 3

Preparation of Magnetorheological Fluid Composition III (1) Acid-Treated Graphene A conventional acid washing method was used. By using the same method as Example 1, graphene (obtained from Taiwan Texitile Research Institute) was dipped into nitric acid or sulfuric acid solution and then processed by supersonic oscillation to obtain the acid-treated graphene grafted with carboxyl moieties (—COOH).

(2) Preparation of Modified Carbonyl Iron Nanoparticles

By using the same method as Example 1, 4-aminobenzoic acid 2 g (purchased from SIGMA) was mixed with deionized water 33.5 ml and stirred for 1~3 hrs. Carbonyl iron powder (purchased from BASF) 5.3 g was added to form a mixture solution. The mixture solution was under supersonic oscillation for 1220 mins and deionized water was used to wash away 4-Aminobenzoic acid. Strong magnet was used to attract all black solids and the upper layer solution was discarded. The above washing process was repeated until the upper layer solution becomes colorless. Then, deionized water was used to dilute the solution to have a total volume of 75 ml. Thus, the solution containing modified carbonyl iron nanoparticles was obtained.

(3) Preparation of Graphene/Carbonyl Iron-Nano-Magnetic-Responsive Composite

The acid-treated graphene (graphene-COOH) 0.67 mg was added into the solution containing modified carbonyl iron nanoparticles and the mixture stayed supersonic oscillation for 24 hrs. After supersonic oscillation, large amount of deionized water was used to wash. Strong magnet was used to attract all black solids and the upper layer solution was discarded. The above washing process was repeated until the upper layer solution becomes colorless. Finally, a freeze-dryer was used to remove deionized water to obtain the graphene/carbonyl iron-nano-magnetic-responsive composite.

(4) Preparation of Magnetorheological Fluid Composition III

In silicone oil (purchased from Dow, polydimethylsiloxane), the graphene/carbonyl iron-nano-magnetic-responsive composite was added to have solid content of 12 wt % so as to obtain the magnetorheological fluid composition III.

Example 4

Preparation of Magnetorheological Fluid Composition IV

Except for having solid content of 43 wt %, example 4 used the same procedure as example 3 so as to obtain the magnetorheological fluid composition IV.

Comparison Example 1

Modified Carbonyl Iron Nanoparticles

In silicone oil (purchased from Dow, polydimethylsiloxane), the modified carbonyl iron-nano-particles (for example, obtained from (3) of example 1) was added to have solid content of 12 wt % so as to obtain the magnetorheological fluid composition V.

TABLE I characteristics of magnetorheological fluid composition

| Composition | Formula* | Solid content (wt %) | Yield Stress(Pa) | Precipitation rate (%) |
|---|---|---|---|---|
| I | a-CNT/CI/S | 12 | 2200 | 0.08% |
| II | a-CNT/CI/S | 43 | 30000 | — |
| III | a-G/CI/S | 12 | 2500 | 0.02% |
| IV | a-G/CI/S | 43 | 32000 | — |
| V | CI/S | 12 | 1800 | 0.2% |

*a-CNT: acid-treated carbon nanotube
a-G: acid-treated graphene
CI: modified carbonyl iron nanoparticle
S: silicone oil Regarding the above yield stress, a dual-plate magneto-rheometer (Physica MCR-301) was used and 5 A current (magnetic strength of 12030 Gs) was applied to the current magnetic control device of the magneto-rheometer and then a flow curve (shear stress versus shear rate) was plotted so as to find out the yield stress. The above precipitation rate was obtained from a laser transmittance meter. The prepared composition I~V was shined with a laser beam to measure the transmittance for each sample. The less the laser energy received by the sensor of the meter is, the better the dispersion is. That is, the transmittance was measured right after blending for at least one hour. The precipitation rate is represented by the transmittance that the laser beam passes through the sample.

In conclusion, according to the magnetorheological fluid composition and the method for forming the same of the present invention, a nano-magnetic-responsive composite is used so as to make the magnetorheological fluid composition have a high yield stress and good dispersion and have variable viscous friction with the change of the magnetic field applied thereon. Thus, the magnetorheological fluid composition can be applied in a smart damper for various devices because of its damping-controllable property. Furthermore, because of its variation in viscosity, the magnetorheological fluid composition can be applied in substance separation, loading or sealing for mechanical devices.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the invention as defined by the following claims. Moreover, no element and component in the present disclosure is intended to be dedicated to the public regardless of whether the element or component is explicitly recited in the following claims. Each of the terms "first" and "second" is only a nomenclature used to modify its corresponding element. These terms are not used to set up the upper limit or lower limit of the number of elements.

What is claimed is:

1. A magnetorheological fluid composition, comprising:

a carrier fluid; and a nano-magnetic-responsive composite dispersed uniformly in the carrier fluid wherein the nano-magnetic-responsive composite is formed by having carbonyl iron microparticles react with a grafting agent to form modified carbonyl iron nanoparticles and blending the modified carbonyl iron nanoparticles with acid-treated graphene or carbon nanotubes, wherein the nano-magnetic-responsive composite has a nano-scaled dimension of 10~100 nm and has a lengthwise dimension, other than the nano-scaled dimension, of 0.5~5 μm; the acid-treated graphene or carbon nanotubes has a nano-scaled dimension of 5~50 nm and has a lengthwise dimension, other than the nano-scaled dimension, of 0.5~20 μm; and the modified carbonyl iron nanoparticle has an average diameter of 5~20 nm.

2. The magnetorheological fluid composition as claimed in claim 1, wherein the nano-magnetic-responsive composite in the carrier fluid has a precipitation rate of less than 0.1 wt % after blending within one hour.

3. The magnetorheological fluid composition as claimed in claim 1, wherein the grafting agent comprises a carboxyl moiety and an amino moiety and the grafting agent is bonded to the modified carbonyl iron nanoparticle through the carboxyl moiety.

4. The magnetorheological fluid composition as claimed in claim 3, wherein the grafting agent is 4-aminobenzoic acid.

5. The magnetorheological fluid composition as claimed in claim 1, wherein the modified carbonyl iron nanoparticles are bonded to the acid-treated graphene or carbon nanotubes through self-assembly to form the nano-magnetic-responsive composite.

6. The magnetorheological fluid composition as claimed in claim 1, wherein having carbonyl iron microparticles react with a grafting agent is performed by blending the modified carbonyl iron nanoparticles with the grafting agent to form a mixture solution and applying supersonic oscillation to the mixture solution until the mixture solution becomes uniform.

7. The magnetorheological fluid composition as claimed in claim 1, wherein the carrier fluid is a fluid of organic compounds.

8. The magnetorheological fluid composition as claimed in claim 1, wherein the carrier fluid is selected from the group consisting of the following: silicone oil, mineral oil and paraffin oil.

9. The magnetorheological fluid composition as claimed in claim 1, wherein the magnetorheological fluid composition has a yield stress more than 2000 Pa.

10. The magnetorheological fluid composition as claimed in claim 1, wherein the nano-magnetic-responsive composite is 10~15 wt % of the magnetorheological fluid composition and a weight ratio of the modified carbonyl iron nanoparticles added in the magnetorheological fluid composition to the acid-treated graphene or carbon nanotubes is 0.01%~0.5%.

11. A damping-controllable magnetorheological fluid material, comprising:

85~90 wt % carrier fluid; and

10~15 wt % nano-magnetic-responsive composite, stably dispersed in the carrier fluid wherein the nano-magnetic-responsive composite is formed by having carbonyl iron microparticles react with a grafting agent to form modified carbonyl iron nanoparticles and blending the modified carbonyl iron nanoparticles with acid-treated graphene or carbon nanotubes;

wherein the grafting agent comprises a carboxyl moiety and an amino moiety; the grafting agent is bonded to the modified carbonyl iron nanoparticle through the carboxyl moiety; and the damping control magnetorheological fluid material has a yield stress more than 2000 Pa.

12. The damping-controllable magnetorheological fluid material as claimed in claim 11, wherein the grafting agent is 4-aminobenzoic acid; the modified carbonyl iron nanoparticles are bonded to the acid-treated graphene or carbon nanotubes through self-assembly to form the nano-magnetic-responsive composite; the nano-magnetic-responsive composite has a nano-scaled dimension of 10~100 nm and has a lengthwise dimension, other than the nano-scaled dimension, of 0.5~5 μm; the acid-treated graphene or carbon nanotubes has a nano-scaled dimension of 5~50 nm and has a lengthwise dimension, other than the nano-scaled dimension, of 0.5~20 μm; and the modified carbonyl iron nanoparticle has an average diameter of 5~20 nm.

* * * * *